US010294625B1

(12) United States Patent
Fontaine et al.

(10) Patent No.: US 10,294,625 B1
(45) Date of Patent: May 21, 2019

(54) SYSTEMS AND METHODS FOR PREVENTING LATERAL SOIL MIGRATION INTO A VOID SPACE OF A LIFTED FOUNDATION

(71) Applicant: Tella Firma, LLC, Richardson, TX (US)

(72) Inventors: James Fontaine, Plano, TX (US); Tony Childress, Plano, TX (US)

(73) Assignee: Tella Firma, LLC, Richardson, TX (US)

( * ) Notice: Subject to any disclaimer, the term of this patent is extended or adjusted under 35 U.S.C. 154(b) by 0 days.

(21) Appl. No.: 15/902,774

(22) Filed: Feb. 22, 2018

(51) Int. Cl.

| | |
|---|---|
| ***E02D 17/08*** | (2006.01) |
| ***E02D 35/00*** | (2006.01) |
| ***E02D 31/00*** | (2006.01) |
| ***E02D 29/02*** | (2006.01) |

(52) U.S. Cl.
CPC ..... *E02D 17/08* (2013.01); *E02D 29/0233* (2013.01); *E02D 31/00* (2013.01); *E02D 35/005* (2013.01)

(58) Field of Classification Search
CPC ..... E02D 17/08; E02D 29/0233; E02D 31/00; E02D 35/005
See application file for complete search history.

(56) References Cited

U.S. PATENT DOCUMENTS

| | | | | |
|---|---|---|---|---|
| 4,373,307 | A * | 2/1983 | Evans | E02D 27/34 52/122.1 |
| 5,791,097 | A * | 8/1998 | Winston | E02D 27/34 52/167.1 |
| 5,934,036 | A * | 8/1999 | Gallagher, Jr. | E04B 5/43 249/188 |
| 6,722,821 | B1 | 4/2004 | Perko et al. | |
| 6,923,599 | B2 | 8/2005 | Kelso | |
| 7,823,341 | B2 | 11/2010 | Kelly et al. | |
| 8,069,620 | B2 | 12/2011 | Kelly et al. | |
| 8,407,898 | B2 | 4/2013 | Marshall | |
| 8,458,984 | B2 | 6/2013 | Marshall | |
| 8,671,627 | B2 | 3/2014 | Marshall | |
| 8,678,712 | B2 | 3/2014 | Marshall | |
| 8,834,072 | B1 * | 9/2014 | Donald | E04G 13/00 405/232 |

(Continued)

FOREIGN PATENT DOCUMENTS

| | | |
|---|---|---|
| CA | 2628422 A1 | 2/2007 |

*Primary Examiner* — Benjamin F Fiorello
(74) *Attorney, Agent, or Firm* — Norton Rose Fulbright US LLP

(57) ABSTRACT

To prevent lateral soil migration beneath a slab foundation lifted over a ground surface, a plurality of skirts are placed in the ground surface to define a foundation perimeter. A slab foundation is formed within an interior space of the foundation perimeter. The plurality of skirts are secured to the slab foundation via one or more anchors protruding from a portion of each skirt toward the interior space of the foundation perimeter. The slab foundation is raised above the ground surface to create a void that permits vertical expansion of soil without subjecting the slab foundation varying forces associated with the dynamic nature of the soil. The plurality of skirts are raised along with the slab foundation and operate as a barrier that circumscribes the void space and resists lateral soil migration into the void from the exterior of the foundation perimeter.

22 Claims, 5 Drawing Sheets

(56) References Cited

U.S. PATENT DOCUMENTS

| | | | | |
|---|---|---|---|---|
| 2007/0028557 | A1* | 2/2007 | Kelly | E02D 27/34 52/741.15 |
| 2010/0011698 | A1* | 1/2010 | Fearn | E02D 27/02 52/742.14 |
| 2012/0288335 | A1 | 11/2012 | Green | |
| 2016/0032554 | A1* | 2/2016 | Hicks | E02D 27/02 52/223.4 |

* cited by examiner

SYSTEMS AND METHODS FOR PREVENTING LATERAL SOIL MIGRATION INTO A VOID SPACE OF A LIFTED FOUNDATION

TECHNICAL FIELD

The present application relates to foundation soil management. More specifically, the application relates to systems and methods of installing perimeter skirts along the periphery of a lifted foundation (i.e., a slab that is formed on a ground or other subjacent surface and is lifted or elevated after its formation to suspend the slab over the subjacent surface, leaving a void between) to prevent lateral soil migration and/or ingress beneath the lifted foundation.

BACKGROUND OF THE INVENTION

The quality of a structure, whether it is a house, apartment building, or commercial office building, is inextricably tied to its foundation. If the structure is not built on a proper foundation, the rest of the structure, even if properly constructed, is likely to show defects over time. When foundations are constructed directly on soils or on the ground, it often creates an unstable environment for the foundation. In addition, if these soils are active or expansive, the environment may be especially problematic. For example, in regions where the soil has a high percentage of active clay, expansion and contraction of the clay subjects the foundations to significant loads (e.g., forces) and potential movement.

Structures built on soils in certain regions may have had their slab foundations and walls displaced and damaged (e.g., cracked foundations and walls) as a result of differential expansion and/or contraction of the soil. Over time, engineers have developed systems and methods for designing foundations in an attempt to minimize damage due to soil movement. Some of these systems and methods include isolating heavy slab foundations from the active soils by suspending the slab above the ground using structural supports (e.g., helical piers, drilled shaft piers, pressed concrete or steel pilings, spread footings, natural rock, etc.) and lifting assemblies (e.g., lifting bolts, hydraulic jacks, air-inflatable jacks, electrical scissor jacks, etc.). The installation of supports and lifts to raise the slab foundation creates a protective void between the soil and the slab foundation. The void permits vertical expansion of the soil without subjecting the slab foundation to varying forces associated with the dynamic nature of soil. This method may also mitigate slab foundation failures due to seismic activity (e.g., earthquakes, tremors, etc.), which may cause the soil to move in a manner that can damage a slab foundation. U.S. Pat. No. 7,823,341 (the "'341 Patent"), HEIGHT-ADJUSTABLE, STRUCTURALLY SUSPENDED SLABS FOR A STRUCTURAL FOUNDATION, issued on Nov. 2, 2010, which is incorporated by reference herein, discloses a method of lifting a slab foundation using structural supports and lifting assemblies.

FIG. 1 shows a cross section of a prior art system for suspending slab foundations as described in the '341 Patent. As the '341 Patent describes, prior to forming slab foundation 170, structural supports 120 are installed into ground surface 110. Lifting assemblies 130 are installed on top of structural supports 120. Also, perimeter trench 140 is excavated along slab foundation 170's intended perimeter prior to pouring the concrete to facilitate the formation of perimeter beams 150 (e.g., an extension of slab foundation 170 into perimeter trench 140).

Typically, concrete is then poured within form boards that are placed along the perimeter of slab foundation 170. The poured concrete also flows into perimeter trench 140, which defines the depth and thickness of perimeter beams 150. Large excavators are typically required to create perimeter trench 140 to ensure that the resulting perimeter beams 150 are of sufficient depth and width to mitigate concrete's low shear strength and inherent structural weaknesses related to creep and/or shrinkage during the curing process. In most situations, foundation reinforcements are installed, prior to pouring the concrete, within the area where the concrete will be poured (e.g., the foundation area and the trenches for the perimeter beams). Installing foundation reinforcements (e.g., post-tension cables, steel, glass, plastic fibers, or hand-tied rebar) may introduce additional labor (e.g., workers cutting and installing the reinforcements) and material costs. Once the concrete is poured to cast slab foundation 170 and perimeter beams 150, the concrete is allowed to cure, and as the concrete cures and strengthens, it is secured to lifting assemblies 130 atop structural supports 120. Although commonly implemented along the periphery of a slab foundation 170, the techniques for forming perimeter beams 150 can also be implemented within the interior of slab foundation 170. For example, perimeter beam 150 may circumscribe a leave out portion of slab foundation 170 designed for an internal garden.

After slab foundation 170 is formed on ground surface 110, lifting assemblies 130 are used to lift slab foundation 170 to a desired height above ground surface 110, thereby creating void 180 between ground surface 110 and slab foundation 170. To lift slab foundation 170, force (e.g., torsion, expansion, or other forces related to the type of lifting mechanisms used) is applied to lifting assemblies 130. On application of sufficient forces, lifting assemblies 130 will raise slab foundation 170 up from ground surface 110. As lifting assemblies 130 lift slab foundation 170, void 180 is created. After the lifting of slab foundation 170, ground surface 110 may expand within void 180. Thus, with void 180 in place, expansion of ground surface 110 within interior space 142 does not result in varying forces on slab foundation 170 resulting from the dynamic nature of soil. However, void 180 is vulnerable to lateral soil migration from beyond the periphery of slab foundation 170 due to soil movement, soil liquefaction, etc. Accordingly, perimeter beams 150, which are formed as an extension of slab foundation 170 and are raised along with slab foundation 170, circumscribe void 180 and may operate as a barrier to lateral migration and/or ingress of soil into void 180 (e.g., lateral migration of soil from beyond the periphery of the slab structure). However, the process of creating perimeter beams 150 is labor intensive and adds significantly to construction time and material costs.

Sometimes, soil retainers may be used to in combination with perimeter beams to mitigate soil migration, but conventional soil retainers can be cumbersome. Often, conventional soil retainers may be installed within perimeter trench 140 such that pouring concrete into perimeter trench 140 results in perimeter beams 150 forming against the soil retainers. The retainers are typically used to prevent soil migration during the formation of slab foundation 170 and perimeter beams 150. Once slab foundation 170 and perimeter beams 150 are raised, the retainers may be raised along with perimeter beams 150 and merely supplement the function of perimeter beams 150. Conventional retainers may be also installed by excavating soil around perimeter beams 150, installing the retainers against perimeter beam 150, and re-compacting soil around perimeter beam 150. However, these conventional soil retainers take for granted, and thus do not address, the material and labor costs and structurally weakness related to perimeter beams 150.

BRIEF SUMMARY OF THE INVENTION

The present invention is directed to methods and systems for preventing lateral soil migration and/or ingress into a void space beneath a lifted foundation using perimeter skirts that are structurally secured to the lifted foundation during formation. The benefits afforded by the void space beneath a lifted foundation may be compromised if there is too much lateral soil migration and/or ingress into the void space from the ground exterior to the perimeter of the slab foundation, thereby filling in and, overtime, eliminating the void space. The perimeter skirts of embodiments replace conventional perimeter beams, which are costly and laborious, and function to circumscribe the void space along the slab foundation's perimeter to operate as a rigid and cost-effective barrier against lateral soil migration.

In accordance with embodiments, narrow trenches may be dug into the ground (e.g., natural ground, level pad site, etc.) using small scale excavators (e.g., drainage spades, trenching shovels, walk-behind trenchers, sprinkler trenchers, portable hand trenchers, etc.) along the perimeter of where a slab foundation will be formed. Preferably, the perimeter trenches are of sufficient width that once the perimeter skirts are placed in the trenches, the trench structure permits vertical movement of the skirts while resisting lateral movement of the skirts. The vertical dimensions of each perimeter skirt may be proportional to the height to which the slab foundation will eventually be raised. In some embodiments, the perimeter skirts may be used in conjunction with form boards to delineate the boundaries for the foundation substrates. Additionally or alternatively, the vertical dimensions of the perimeter skirts may be sufficiently long enough to delineate the foundation boundaries without needing to use separate form boards.

Each perimeter skirt of embodiments may have anchors (e.g., pins, nails, screws, etc.) protruding from portions of the skirt. These anchors are oriented towards the interior of the region defined by the perimeter trenches and the perimeter skirts and are preferably configured for structurally securing the perimeter skirts to a formed slab foundation. In some embodiments, the anchors may be installed onto the perimeter skirt prior to placing the perimeter skirts in the perimeter trenches. Additionally or alternatively, the anchors may be installed onto the perimeter skirts after the slab foundation has been formed.

According to embodiments, foundation substrates (e.g., concrete or other types of foundation material) may be poured into the interior region defined by the perimeter trenches and the perimeter skirts. Once the foundation substrates have been properly cured, the perimeter skirts of embodiments may become structurally secured to the slab foundation, such as via the aforementioned anchors. In accordance with one aspect of embodiments, the anchors may have surface deformations and/or perturbations (e.g., ridges, grooves, hooks, etc.) configured to prevent the anchors, and the perimeter skirts, from separating from the slab foundation. Lifting the slab foundation in accordance with embodiments results in the creation of a void space between the slab foundation and the ground. By virtue of their attachment to the slab foundation via anchors, the perimeter skirts are lifted along with the slab foundation and may circumscribe the void space along the slab foundation's perimeter. Although each perimeter skirt may be raised along with the slab foundation, a portion of each skirt preferably remains within the perimeter trenches. The combination of the trench portion of each perimeter skirt and the portion of each skirt secured to the lifted foundation by the anchors operate as footholds to allow the perimeter skirt resist lateral soil migration.

Using perimeter skirts instead of conventional perimeter beams (e.g., extensions of slab foundation 170 into perimeter trench 140 as discussed with respect to FIG. 1) to preserve the integrity of the void space results in using less quantities of substrate materials. This may also result in shorter overall curing times, as the curing times for the slab foundation are no longer dependent on the curing times for the perimeter beams, which could vary depending on soil moisture levels (e.g., proportional to the soil depths to which the perimeter beams extended). Further, perimeter skirts of embodiments are not subjected to the same creep and shrinkage issues related to perimeter beams, which can compromise the structural integrity of perimeter beams and undermine their capacity to resist soil migration and/or ingress over time. Additionally, the removal of conventional perimeter beams may result in using lesser quantities of foundation reinforcements, such as rebar and ties. Also, the perimeter skirt materials (e.g., vinyl sheet, sheet metal, wood panel, etc.) are often cheaper than the materials used in perimeter beams (e.g., concrete, rebar and ties, etc.) and easier to install. These factors, separately and in the aggregate, contribute to reduced material and labor costs when using perimeter skirts over perimeter beams.

In some embodiments, the anchors and the perimeter skirts may be selectively removed and/or replaced, thereby allowing access to the void space beneath a lifted foundation or permitting repair of damaged perimeter skirts. Due to the static nature of conventional perimeter beams (e.g. sold concrete beams), access to the void space could only be accomplished by either lifting the slab foundation and compromising the circumscribed void space along the entire periphery of the foundation, digging underneath the perimeter beams, or selectively destroying portions of the perimeter beams.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 2A:
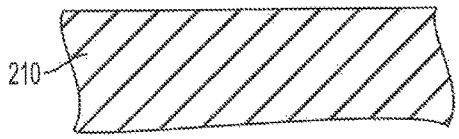
FIGS. 2A through 2E illustrate a process for constructing a lifted foundation with perimeter skirts to prevent lateral soil migration and/or ingress, in accordance with an embodiment of the invention.

FIGS. 2A through 2E illustrate a process for constructing a lifted foundation with perimeter skirts to prevent lateral soil migration and/or ingress, in accordance with embodiments of the invention. FIG. 2A illustrates a location of ground surface 210 where a new foundation is to be formed. Ground surface 210 of embodiments may be natural ground (e.g., soil, dirt, or other natural ground materials) or a level pad site (e.g., a level layer of soil, dirt, gravel, sand, silt, clay, other types of fill material, or combinations thereof atop natural ground).

Figure 1:
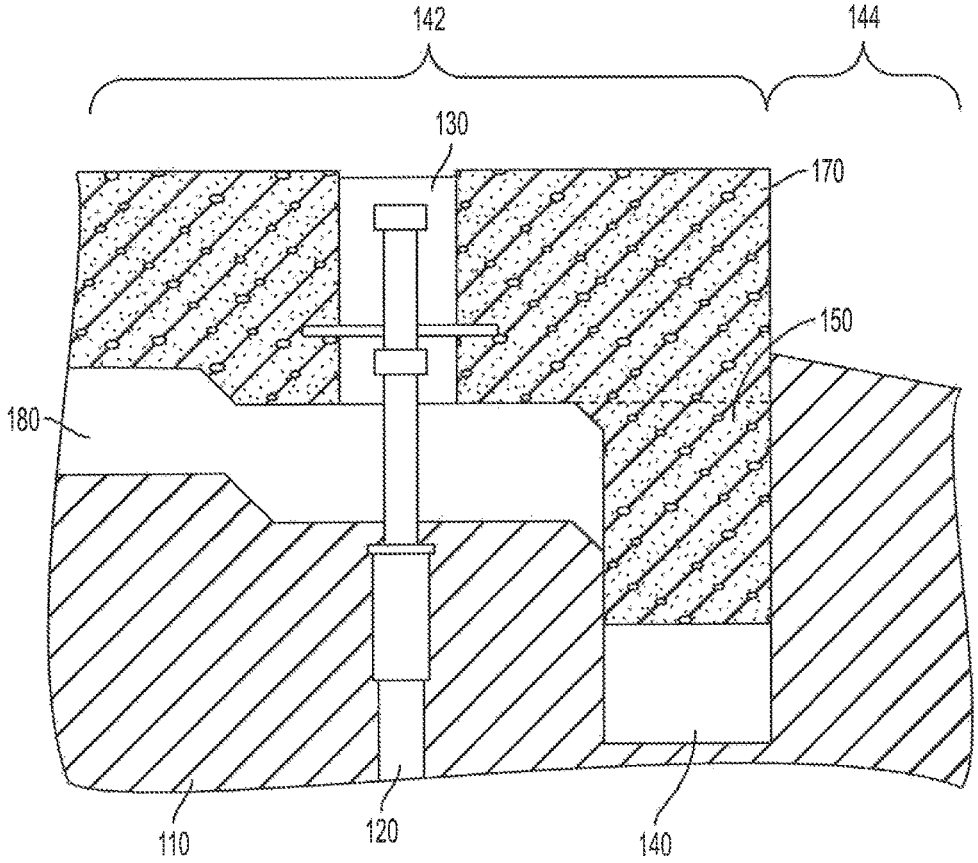
FIG. 1 PRIOR ART
FIG. 1 illustrates a prior art system for preventing lateral soil migration and/or ingress beneath a lifted foundation.
Figure 2B:
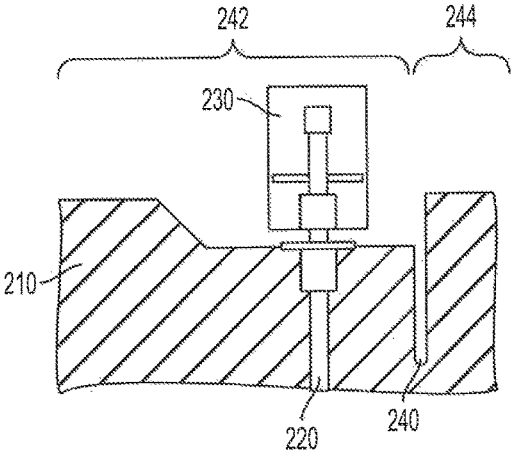

As illustrated in FIG. 2B, perimeter trench 240 may be dug along a perimeter of where the new foundation will be formed. In accordance with embodiments, perimeter trench 240 defines an interior space 242 and an exterior space 244 of the foundation's perimeter. Preferably, perimeter trench 240 is narrower than perimeter trench 140 of FIG. 1 because the required thickness of perimeter trench 140, needed to mitigate perimeter beam 150's structural weaknesses related to shear forces, creep, and shrinkage, are obviated by aspects of the present invention. Thus, perimeter trench 240 of embodiments may be dug into ground surface 210 using small excavators such as drainage spades, trenching shovels, walk-behind trenchers, sprinkler trenchers, portable hand trenchers, any other form of small-scale trenching tools, or combinations thereof. The depth of perimeter trench 240 may correspond to the vertical dimensions of one or more perimeter skirts (e.g., a plurality of perimeter skirt 250 as depicted via cross section in FIGS. 2C-2E). Preferably, the thickness of perimeter trench 240 is only as wide as necessary as to accommodate the installation of perimeter skirts. For example, once perimeter skirt 250 has been placed within perimeter trench 240, as discussed further below, ground surface 110 surrounding perimeter trench 240 may sufficiently hold perimeter skirt 250 in place, with little or no lateral movement. It should be appreciated that, although shown as a cross section, perimeter trench 240 of embodiments may extend around the entire periphery of the intended foundation.

In some embodiments, a plurality of structural supports (e.g., at least one of structural support 220) may be placed in ground surface 210 at spaced-apart locations within interior space 242. Structural support 220 may comprise helical piers, drilled shaft piers, pressed concrete or steel pilings, spread footings, natural rock, any other type of structure for providing vertical support, or combinations thereof. The layout and spacing of the structural supports (e.g., at least one of structural support 220) may be determined according to the design of the foundation to be formed, among other design parameters. The elevation of structural support 220 may be determined according to desired void size (e.g., void 280 of FIG. 2E) and desired slab elevation (e.g., the suspended height of slab foundation 270 of FIG. 2E). Once the plurality of structural supports are in place, lifting assembly 230 may be installed over each structural support. Lifting assembly 230 may comprise lifting bolts, hydraulic jacks, air-inflatable jacks, electrical scissor jacks, structurally-lockable lifting devices (e.g., pumping mortar into a piston pipe), any other type of lifting apparatus, or combinations thereof. These lifting assemblies (e.g., at least one of lifting assembly 230) may be constructed from metal (e.g., different types of steel), composite materials (e.g., carbon fiber composites, engineered materials, etc.), polymers and/or the like, or combinations thereof. Although structural supports and lifting assemblies are depicted in FIGS. 2B-2E for raising slab 270, it is noted that this for purposes of illustration, rather than by way of limitation, and embodiments of the present invention may utilize additional or alternative means for supporting and lifting slab foundation 270.

Figure 2C:
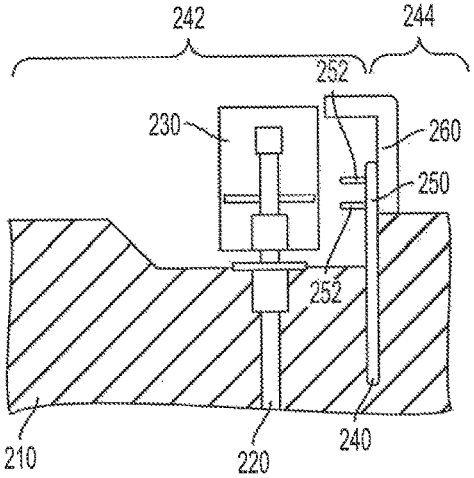

As illustrated in FIG. 2C, in accordance with embodiments of the present invention, before a foundation substrate (e.g., concrete or other types of foundation material) is poured to form slab foundation 270 (e.g., slab foundation 270 of FIG. 2D), one or more perimeter skirts (e.g., a plurality of perimeter skirt 250) may be placed in perimeter trench 240. Although embodiments herein describe the process for preventing lateral soil migration and/or ingress with respect to a select perimeter skirt (e.g., perimeter skirt 250 as depicted via cross section in FIGS. 2C-2E), it should be appreciated that the concepts herein may likewise apply to a plurality of perimeter skirts placed within perimeter trench 240 that circumscribe slab 270.

Perimeter skirt 250 of embodiments may comprise plastic sheets, vinyl sheets, metal sheets (e.g., steel, aluminum, etc.), wood panels, concrete tiles, ceramic tiles, any other thin materials suitable for resisting soil migration and/or ingress, or combinations thereof, in accordance with the concepts described herein. For example, vinyl panels used for soil retention walls may be utilized as perimeter skirt 250. In some embodiments, perimeter skirt 250 may comprise laminations of various materials. Additionally or alternatively, perimeter skirt 250 may comprise internal structures (e.g., corrugation, honeycombing, etc.) that promote rigidity, resist lateral soil migration, and/or encourage interfacing with slab foundation 270. For example, perimeter skirt 250 may be constructed using two sheets of plastic applied on a plastic honeycomb layer, thereby offering a sandwich panel with suitable rigidity at minimal weight. In another example, an interior side of perimeter skirt 250 facing interior space 242 may comprise a corrugated structure upon which poured foundation substrates may interact with and slab foundation 270 may interface. Perimeter skirt 250 of embodiments may also comprise aesthetic features such as color, texture, or combinations thereof suitable for blending and/or incorporating into the design of the exterior structure built atop slab foundation 270. In some embodiments, perimeter skirt 250 may comprise internal insulation such as, for example, perlite, expanded polystyrene, polyurethane, polyisocyanurate, rigid cellular polystyrene, compressed wheat straw, epoxy, other types of panel insulation, or combinations thereof. For example, perimeter skirt 250 may be constructed using two panels of plywood sandwiched around a core of high-density expanded polystyrene, thereby offering a rigid panel with suitable thermal and moisture resistance.

Perimeter skirt 250 of embodiments include anchors 252 that protrude from the first portion of perimeter skirt 250's towards interior space 242. Anchors 252 may comprise pins, nails, screws, multilayered adhesives, any anchoring device suitable for anchoring the skirt material to the slab foundation as described herein, or combinations thereof. For example, anchors 252 may comprise snap-in pins that are installed through fasteners within perimeter skirt 250. In another example, anchors 252 may be nails that are installed through perimeter skirt 250 using a hammer, mallet, or other percussion tool. In yet another example, anchors 252 may be screws that have been installed through perimeter skirt 250 using a screwdriver, a drill, or other torsion tool. The surfaces of anchors 252 may include ridges, grooves, hooks, or other surface deformations and/or perturbations configured to prevent anchors 252, and perimeter skirt 250, from sliding apart from a formed slab (e.g., slab foundation 270 of FIG. 2D). For example, anchors 252 may be double-sided tape with an adhesive surface suitable for attaching to perimeter skirt 250 and an textured surface into which poured foundations substrates may be cast. In some embodiments, anchors 252 may be installed onto perimeter skirt 250 prior to placing perimeter skirt 250 in perimeter trench 240. For example, anchors 252 may be snapped into fasteners of perimeter skirt 250 before installing perimeter skirt 250 into perimeter trench 240. In another example, perimeter skirt 250 may have been obtained from a manufacturer with anchors 252 pre-installed. In additional or alternative embodiments, anchors 252 may be installed onto perimeter skirt 250 after formation of slab foundation 270. For example, prior to lifting slab foundation 270, form board 260 may be removed and anchors 252 may be installed through perimeter skirt 250, such that anchors 252 are embedded into slab foundation 270, thereby securing perimeter skirt 250 to slab foundation 270. Anchors 252 of embodiments may also be an extension of perimeter skirt 250, as described below with respect to FIG. 3B. It is noted that, in FIGS. 2C through 2E, anchors 252 are shown as two anchors for purposes of illustration, rather than by way of limitation, and according to embodiments of the present invention, each of the plurality of perimeter skirts may contain more than two or less than two anchors.

According to embodiments, perimeter skirt 250 may be placed in perimeter trench 240 in such a manner that a first portion of perimeter skirt 250 extends above ground surface 210, while a second and a third portion of perimeter skirt 250 are slotted within perimeter trench 240, beneath ground surface 210. The vertical dimensions of the first portion of perimeter skirt 250 (e.g., the portion of perimeter skirt 250 above ground surface 210) may be the minimum amount of material necessary to provide sufficient area for anchors 252 and to ensure that perimeter skirt 250 does not buckle under varying, dynamic forces on perimeter skirt 250 caused by lateral soil migration. In some embodiments, the vertical dimensions of the first portion of perimeter skirt 250 may extend nearly or fully along the planned thickness of slab foundation 270 (e.g., slab foundation 270 of FIG. 2D). In such embodiments, the perimeter skirts (e.g., a plurality of perimeter skirt 250) may operate in conjunction with or lieu of form boards (e.g., a plurality of form board 260) to facilitate the formation of slab foundation 270. Although embodiments herein describe the process for preventing lateral soil migration with respect to a portion of perimeter skirt 250 extending above ground surface 210, it should be appreciated that the concepts herein may likewise apply to a first portion of perimeter skirt 250 that is embedded within perimeter trench 240 along with the second and third portions of perimeter skirt 250, angled such that the first portion is flush with ground surface 210, any other configuration suitable for securing perimeter skirt 250 to a formed slab foundation 270 as described herein, or combinations thereof.

Figure 2D:
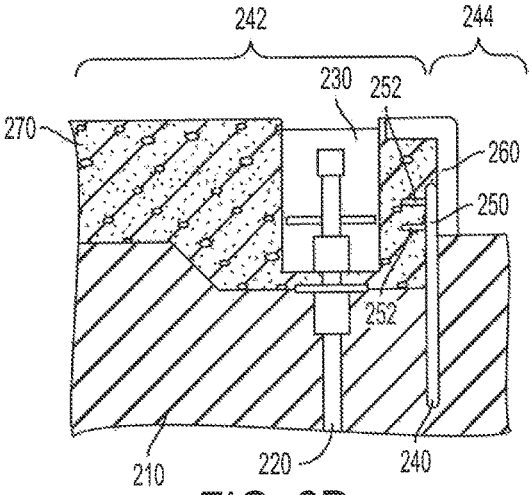
Figure 2E:
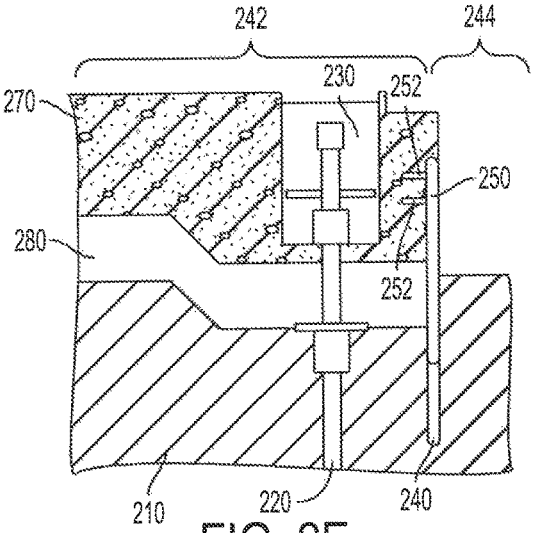

The vertical dimensions of the second portion of perimeter skirt 250 may depend on the desired height to which slab foundation 270 will raised be above ground surface 210 (as discussed with respect to FIG. 2E). Preferably, the vertical dimensions of the second portion of perimeter skirt 250 (e.g., the portion of perimeter skirt 250 below ground surface 210 and within perimeter trench 240) exceeds the intended vertical dimensions of the void space between a lifted foundation and the ground (e.g., void space 280 of FIG. 2E). Thus, when slab foundation 270 is raised above ground surface 210 according to embodiments, perimeter skirt 250, due to its coupling to slab foundation 270 via anchors 252, may circumscribe the newly formed void space without exposing the void space to soils at ground surface 210 of exterior space 244 (as described with respect to FIG. 2E).

The third portion of perimeter skirt 250 preferably remains within perimeter trench 240, even after slab foundation 270 has been raised. The vertical dimensions of the third portion of perimeter skirt 250 may be the minimum amount of material suitable to ensure that perimeter skirt 250 does not buckle under varying, dynamic forces against perimeter skirt 250 caused by lateral soil migration. For example, after slab foundation 270 has been raised, the first and third portions of perimeter skirt 250 may operate as footholds to allow the perimeter skirt resist lateral soil migration.

In some embodiments, one or more form boards (e.g., a plurality of form board 260) may be placed around the perimeter of the intended foundation to facilitate the formation of slab foundation 270 by defining the limits to which the poured foundation substrate may expand. The form boards of embodiments may be installed over perimeter skirt 250, with perimeter skirt 250 lining the inside (e.g., side facing interior space 242) of the form boards. Form board 260 of embodiments may be constructed from wood, metal, polymers, plastic, fiberglass, resin, other rigid materials, or combinations thereof. In additional or alternative embodiments, perimeter skirt 250 may operate in conjunction with or in lieu of form board 260 to delineate the limits to which the poured foundation substrate may expand. In some embodiments, form board 260 may include an angled portion to facilitate formation of a recess within slab foundation 270. For example, as depicted in FIGS. 2C-2D, the recess cast within slab foundation 270 by form board 260 may operate as a brick ledge upon which exterior bricks may be placed to prevent water leakage into the interior of a structure built atop slab foundation 270. Alternatively, the form boards may exclude an angled portion, as depicted below with form board 350 of FIGS. 3B-3C. Although embodiments may be described herein with respect to a select form board (e.g., form board 260 as depicted via cross section in FIGS. 2C-2E), it should be appreciated that the concepts herein may likewise apply to a plurality of form boards placed around the periphery of slab foundation 270.

As illustrated in FIG. 2D, one or more foundation substrates may be poured over the structural supports (e.g., at least one of structural support 220), the lifting assemblies (e.g., at least one of lifting assembly 230), and the anchors of each perimeter skirt (e.g., a plurality of perimeter skirt 250 and anchors 252). Once the poured substrates reach adequate strength, slab foundation 270 will become fixed to anchors 252 of perimeter skirt 250 and lifting assembly 230, which in turn is supported by structural support 230 fixed in ground surface 210. Form boards (e.g., a plurality of form board 260) of embodiments may be removed once the curing process for slab foundation 270 is completed. It is noted that the attachment of slab foundation with respect to perimeter skirt 250, lifting assembly 230, and structural support 230 are for purposes of illustration, rather than by way of limitation; once slab foundation 270 has been cured according to embodiments, slab foundation 270 may be fixed to a plurality of perimeter skirts, lifting assemblies, and structural supports. In some embodiments, perimeter beams (e.g., perimeter beams 150 of FIG. 1) may not be completely removed; instead, smaller versions of the perimeter beams may nevertheless remain for purposes other than managing soil migration (e.g., to provide a termite or pest barrier, to meet code requirements that some minimum amount of foundation material be provided along the edges, etc.), and perimeter skirt 250 may be structurally secured to slab foundation 270 and/or the reduced perimeter beams via anchors 252. Even in such embodiments, there may be significant reductions in material (e.g., amount of concrete poured, amount of foundation reinforcements used, etc.) and labor (e.g., amount of time to excavate full perimeter beam trenches, install foundation reinforcements, etc.) costs when compared to using conventional perimeter beams to manage lateral soil migration.

As illustrated in FIG. 2E, slab foundation 270 of embodiments may be raised to a pre-specified amount above ground surface 210 by actuating the lifting assemblies (e.g., at least one of lifting assembly 230). Lifting slab foundation 270 according to embodiments creates void 280, which comprises the distance from the bottom of slab foundation 270 to the top of ground surface 210 after slab foundation 270 has been raised. The pre-specified amount that slab foundation 270 may be raised and the desired size of void 280 under slab foundation 270 may be determined from soil reports, load of structures to be built on top of slab foundation 270, or based on other factors as desired by building engineers, architects, contractors, or other foundation experts. In accordance with embodiments of the present invention, due to anchors 252, perimeter skirt 250 is raised along with slab foundation 270. Thus, the perimeter skirts of embodiments may operate as a barrier between void 280 of interior space 242 and the soil of ground surface 110 of exterior space 244. In this way, the perimeter skirts are able to prevent lateral migration and/or ingress of soil from exterior space 244 into void 280, thereby allowing void 280 to continue to function as a protective buffer for varying forces resulting from the dynamic nature of soil against slab foundation 270 caused by vertical soil expansion in interior space 242. In additional or alternative embodiments, anchors 252 may be selectively removed and/or replaced, thereby allowing for the removal and/or replacement of perimeter skirt 250 to facilitate access to void 280 or repair damage to perimeter skirt 250. For example, after slab foundation 270 has been raised and a structure built upon slab foundation 270, a plumber or electrician may seek access to plumbing or electrical wiring within void 280 to accomplish repairs.

Figure 3C:
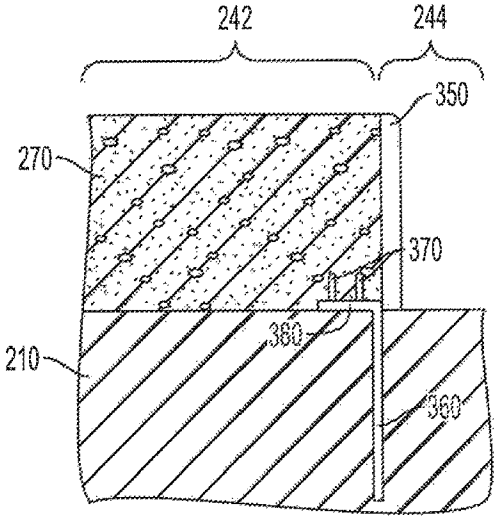
FIGS. 3A through 3C illustrates various configurations for constructing a lifted foundation with perimeter skirts to prevent lateral soil migration and/or ingress, in accordance with embodiments of the invention.
Figure 3B:
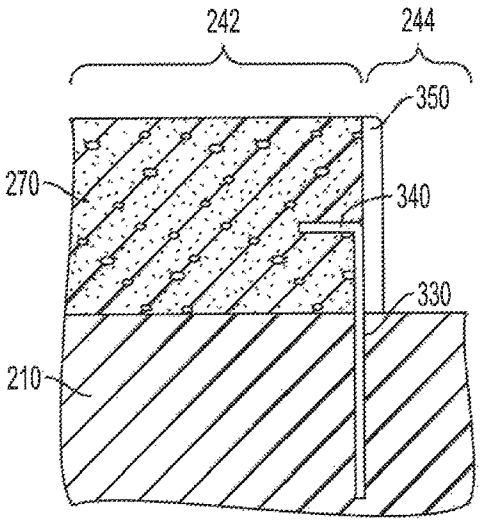
Figure 3A:
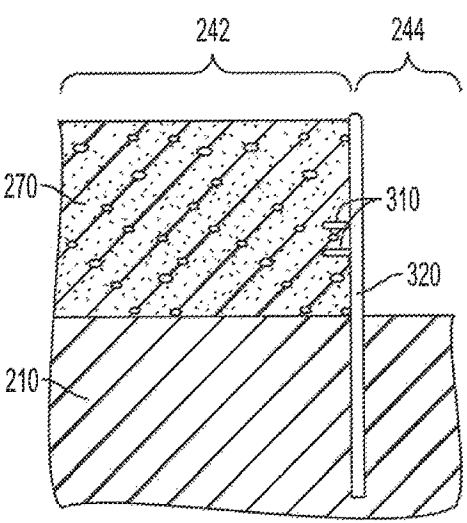

FIGS. 3A through 3D illustrates various configurations for securing perimeter skirts to a slab foundation, in accordance with embodiments of the invention. FIG. 3A depicts anchors 310 protruding from perimeter skirt 320. In some embodiments, the vertical length of perimeter skirt 320 extends along the entire thickness of slab foundation 270 and are suitable for delineating the boundaries to which foundation substrates may flow to form slab foundation 270 without requiring separate form boards. Anchors 310 preferably protrude from an interior side of perimeter skirt 320 (e.g., the side of perimeter skirt 320 facing interior space 242) and operate to structurally secure perimeter skirt 320 to slab foundation 270.

FIG. 3B illustrates perimeter skirt 330 cast within slab foundation 270. Perimeter skirt 330 may be manufactured in such a way that a portion of perimeter skirt 330 is angled toward interior space 242 such that angled portion 340 of perimeter skirt 330 may operate in accordance with the concepts described herein with respect to anchors (e.g., anchors 252 of FIGS. 2C-2E, anchors 310 of FIG. 3A, etc.). Pouring foundation substrates in accordance with embodiments results in slab foundation 270 forming within the boundaries delineated by form board 350 and around angled portion 340. In additional embodiments, supplemental anchors may protrude from the surface of angled portion 340 to ensure that perimeter skirt 330 is structurally secured to slab foundation 270. For example, anchors may protrude from a surface of angled portion 340 toward and/or away from ground surface 210, such that slab foundation 270 forms around angled portion 340 and any supplemental anchors protruding from angled portion 340.

FIG. 3C illustrates perimeter skirt 360 structurally secured to the underside of slab foundation 270 via anchors 370. Anchors 370 protrude from angled portion 380 away from ground surface 210. Pouring foundation substrates in accordance with embodiments results in slab foundation 270 forming within the boundaries delineated by form board 350 and around anchors 370. Once the foundation substrates are properly cured, perimeter skirt 360 is preferably secured to the underside of slab foundation 270 via anchors 370.

Figure 4A:
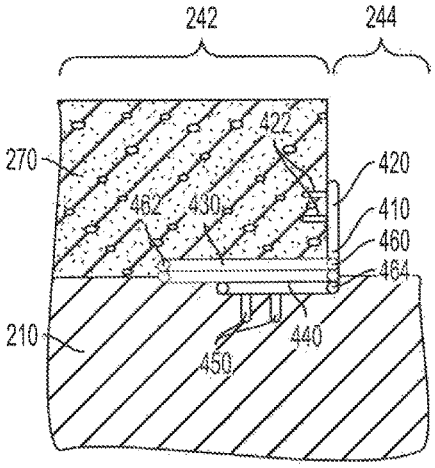
FIGS. 4A through 4C illustrates system for preventing lateral soil migration and/or ingress beneath a lifted slab foundation, in accordance with embodiments of the invention.
Figure 4B:
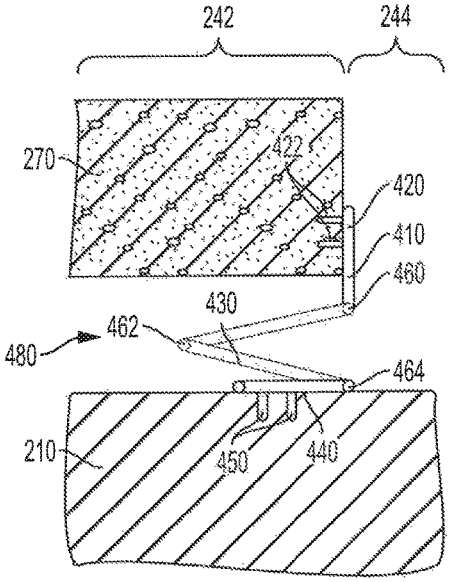
Figure 4C:
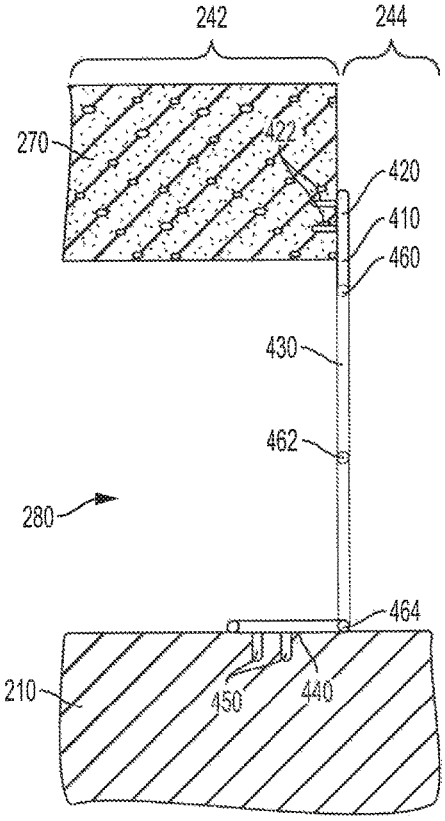

FIGS. 4A through 4C illustrates a system for preventing lateral soil migration and/or ingress beneath a lifted slab foundation, in accordance with embodiments of the invention. As depicted in FIG. 4A, in some embodiments, perimeter trenches may not be necessary. Instead, perimeter skirt 410 may be secured directly to ground surface 210. According to embodiments, first portion 420 of perimeter skirt 410 may be oriented perpendicular to ground surface 210, with anchors 422 protruding from an interior side of perimeter skirt 410 (e.g., the side facing interior surface 242). First portion 420, alone (e.g., if of sufficient vertical length) or in conjunction with form boards, may delineate the boundaries to which foundation substrates may flow to form slab foundation 270. Anchors 422 of embodiments may operate to structurally secure first portion 420 of perimeter skirt 410 to a formed slab foundation 270.

Second portion 430 of embodiments preferably corresponds to the height to which slab foundation 270 will be lifted (e.g., the final dimensions of void 280) and may be folded along pivot points 460, 462, and 464. Foundation substrates may be poured over folded second portion 430, and slab foundation 270 may be formed atop second portion 430, preferably in such a manner that second portion 430 may unfold along pivot points 460, 462, and 464. Although perimeter skirt 410 is depicted with three pivot points along which second portion 430 may fold, it is noted that this for purposes of illustration, rather than by way of limitation, and embodiments of the present invention may utilize less or more than three pivot points. Third portion 440 of perimeter skirt 410 is preferably oriented parallel to ground surface 110 and secured to ground surface 210 via soil anchors 450. Soil anchors 450 of embodiments may be anchor spikes, sod pins, soil nails, any other type of fasteners suitable for securing perimeter skirts to soil, or combinations thereof. It is noted that, in FIGS. 4A through 4C, soil anchors 450 are shown as two anchors for purposes of illustration, rather than by way of limitation, and according to embodiments of the present invention, each perimeter skirt may contain more than two or less than two soil anchors.

As illustrated in FIG. 4B, once poured foundation substrates have cured, slab foundation 270 may be raised. In accordance with embodiments, first portion 420 and third portion 440 preferably remain secured to slab foundation 270 and ground surface 210, respectively. According to embodiments, as slab foundation 270 is being raised, space 480 is created between slab foundation 270 and ground surface 210. Because first portion 420 of embodiments is secured to slab foundation 270 via anchors 422, first portion 420 of perimeter skirt 410 is raised along with slab foundation 270. Raising first portion 420 preferably exerts an upward force on second portion 430, thereby causing second portion 430 to unfold along pivot points 460, 462, and 464. FIG. 4C illustrates slab foundation 270 in a fully raised position, in accordance with embodiments. Once slab foundation 270 is raised to its desired height, space 480 achieves its desired dimensions and results in void 280 (e.g., void 280 of FIG. 2E). Second portion 430 is preferably unfolded into a fully extended position and operates as a barrier to lateral soil migration. It is noted that although FIGS. 4A through 4C illustrate securing perimeter skirts to ground surface 210 without perimeter trenches, it is noted that perimeter skirts with soil anchors may be used in conjunction with perimeter skirts embedded in perimeter trenches.

Figure 5:
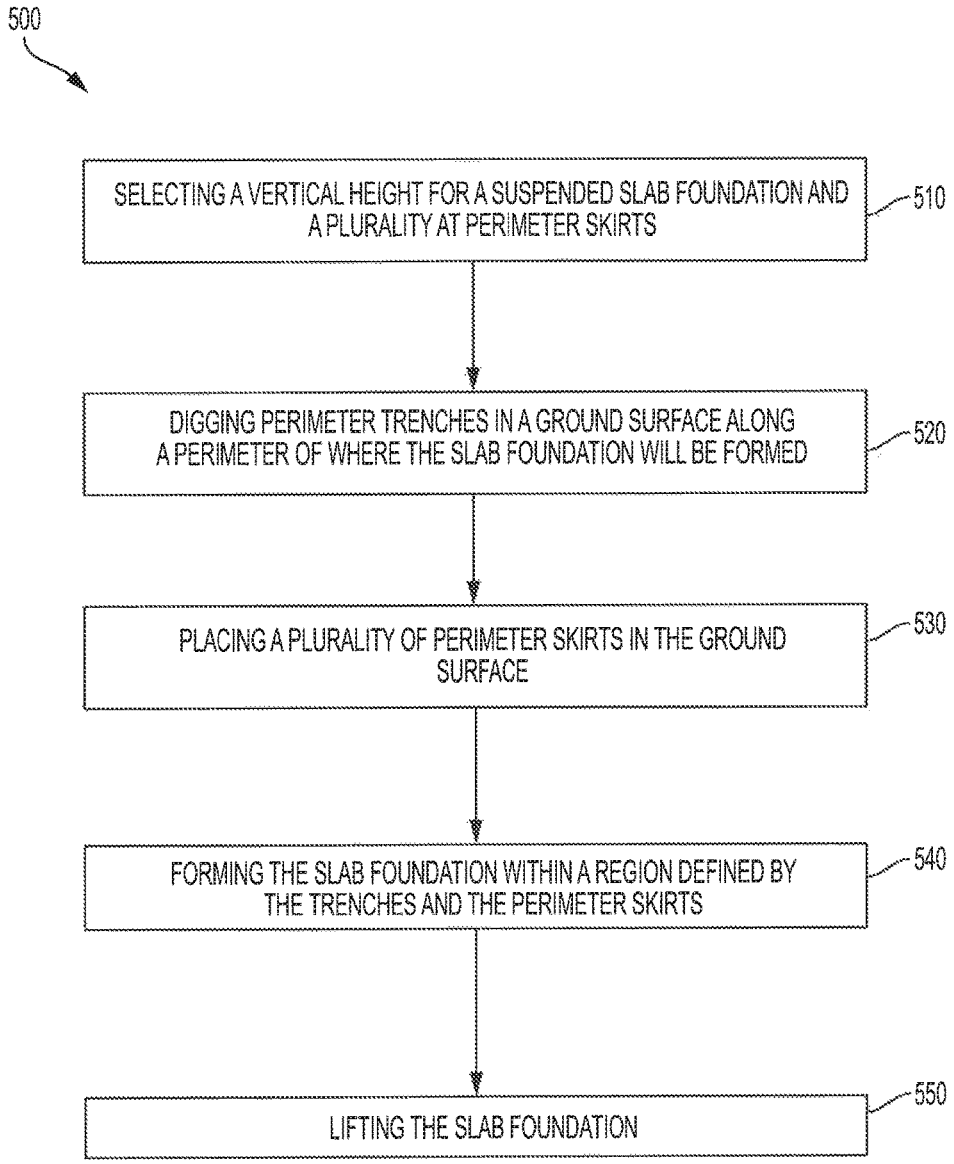
FIG. 5 illustrates a flow diagram of an embodiment of a method for preventing lateral soil migration and/or ingress according to embodiments of the invention.

FIG. 5 illustrates process steps in a method for preventing lateral soil migration and/or ingress beneath a lifted slab foundation according to embodiments of the invention. Process 500 may begin at block 510, which includes selecting a vertical height for a lifted foundation and a plurality of perimeter skirts. According to embodiments, the vertical dimensions (described herein with respect to a first, second, and third portion) of the perimeter skirts (e.g., a plurality of perimeter skirt 250 of FIGS. 2C-2E) are preferably proportional to the height to which a slab foundation (e.g., slab foundation 270 of FIGS. 1D-1E) will eventually be raised and to the amount of materials secured to the slab foundation and embedded in the ground surface. The vertical dimensions of the first portion may be the minimum amount of material necessary to accommodate the installation of protruding anchors (e.g., a plurality of anchors 252 of FIGS. 2C-2E) into each perimeter skirt and to ensure that the perimeter skirts do not buckle under varying, dynamic forces against the perimeter skirts caused by lateral soil migration. In some embodiments, the vertical dimensions of the first portion may correspond to the desired thickness of the intended slab foundation and, thus, may be suitable for functioning in conjunction with or in lieu of form boards (e.g., a plurality of form board 260 of FIG. 2C-2D) to facilitate formation of the slab foundation.

The vertical dimensions of the second portion of each perimeter skirt are, preferably, greater than the intended vertical dimensions of a void space (e.g., void 280 of FIG. 2E) that will be formed as the slab foundation is raised above the ground surface. In this way, raising the slab foundation causes the perimeter skirts (as discussed with respect to block 550) to also be raised and thereby circumscribe the newly formed void space without exposing the void space to soil at the exterior of the foundation perimeter (e.g., exterior space 244 of FIGS. 2B-2E). The third portion of each perimeter skirt may remain within the perimeter trenches, even after the slab foundation has been raised. The vertical dimensions of the third portion of each perimeter skirt may be the minimum amount of material suitable to ensure that the perimeter skirts do not buckle under varying, dynamic forces against the perimeter skirts caused by lateral soil migration. For example, after the slab foundation has been raised, the first and third portions of each perimeter skirt may operate as footholds to allow the perimeter skirt resist lateral soil migration.

Once appropriate dimensions have been selected for the perimeter skirts, at block 520, process 500 may further include digging trenches in a ground surface along a perimeter of where the slab foundation will be formed. Because wide trenches are no longer necessary to facilitate the curing and structural requirements of concrete perimeter beams, the trenches of embodiments may only be as wide as necessary to accommodate the thickness of the perimeter skirts. As such, the perimeter trenches (e.g., perimeter trench 240 of FIGS. 2A-2E) may be dug using small excavators. According to embodiments, the perimeter trenches may extend around the entire periphery of the intended foundation. The depth of the perimeter trenches may correspond to the vertical dimensions of one or more perimeter skirts (e.g., a plurality of perimeter skirt 250 as depicted via cross section in FIGS. 2C-2E). Preferably, the thickness of the perimeter trenches are only as wide as necessary as to accommodate the installation of perimeter skirts. For example, once the perimeter skirts have been placed within the perimeter trenches, the ground surface (e.g., ground surface 210 of FIGS. 2A-2E) surrounding the perimeter trenches may sufficiently hold the perimeter skirts in place, with little or no lateral movement.

In some embodiments, structural supports may be placed in a ground surface. As noted above, the structural supports (e.g., at least one of structural support 220 of FIGS. 2B-2E) of embodiments may be installed in the ground to provide support for a structure built atop a slab foundation (e.g., slab foundation 270 of FIGS. 2D-2E). The structural supports may be installed by driving the structurally supports in the ground by a downward force or screwing the structural supports into the ground by a torsion (e.g., turning) force applied to the structural supports. The structural supports may be evenly distributed within a region (e.g., interior space 242 of FIGS. 2B-2E) of the ground where the slab foundation will be formed. The length of each structural support may depend on a desired height to which the slab foundation will eventually be raised and on geological features of the ground surface, such as the depth at which stable soil is available. This may include first determining the location of unstable and stable soil zone in the ground in which the structural supports are to be installed. For example, if it is determined that the upper surface of the ground is clay (i.e., active soil), a determination may be made as to how deep the clay extends below the surface. This determination may be made, for example, by analyzing soil core samples, examining geological data, reviewing geological surveys, running computerized models, or any other form of topography analysis, or combinations thereof.

In additional embodiments, each structural support may be mechanically coupled to a lifting assembly of a plurality of lifting assemblies. The lifting assemblies (e.g., a plurality of lifting assembly 240 of FIGS. 2B-2E) may be installed over the structural supports after the structural supports have been placed into the ground. Lifting assemblies of embodiments may be installed on the structural supports via welding, screwing, interlocking, or other forms of fastening, or combinations thereof. Additionally or alternatively, the lifting assemblies may be attached to the structural supports prior to placing the structural supports in the ground. For example, the structural support and the lifting assembly may be separately manufactured, and one end of the structural support may be screwed into treaded holes within the lifting assembly. Once the structural support and the lifting assembly are attached together, the combined apparatus may be placed into the ground. In another example, the structural support and the lifting assembly may be manufactured as a single apparatus that is then placed into the ground.

Once trenches have been dug along the entire periphery of the intended foundation, at block 530, process 500 may further include placing a plurality of perimeter skirts in the ground surface. The perimeter skirts (e.g., a plurality of perimeter skirt 250 of FIGS. 2C-2E) may be installed within the perimeter trenches. In some embodiments, placing perimeter skirts into perimeter trenches according to embodiments results in the first portion of the perimeter skirt above the ground surface and the second and third portions of the perimeter skirt below the ground surface. One or more form boards (e.g., a plurality of form board 260 of FIGS. 2C-2E) may be placed around the perimeter of the intended foundation to facilitate the forming the slab foundation by defining the limits to which the poured foundation substrate may expand. The form boards may be installed over the perimeter skirt, with each perimeter skirt lining the inside of each form board. In additional or alternative embodiments, the length of the perimeter skirts may allow the skirts to operate in conjunction with or in lieu of the form board to define the limits to which the poured foundation substrate may expand.

In some embodiments, anchors (e.g., pins, nails, screws, etc.) may be installed onto each perimeter skirt prior to placing the perimeter skirts in the perimeter trenches. For example, anchors may be snapped into fasteners of one or more perimeter skirts before installing the perimeter skirts into the perimeter trenches. In another example, one or more perimeter skirts may have been obtained from a manufacturer with anchors pre-installed. In additional or alternative embodiments, the anchors may be installed onto one or more perimeter skirts after the slab foundation has been formed. For example, prior to lifting the slab foundation, any form boards used to form and cure the slab foundation may be removed and anchors may be installed through one or more of the perimeter skirts, such that anchors are embedded into the slab foundation, thereby securing the perimeter skirts to the slab foundation.

At block 540, the slab foundation is formed within the region defined by the perimeter trenches and the perimeter skirts (e.g., interior space 242 of FIGS. 2B-2E). Once foundation substrates (e.g., concrete or other foundation materials) are poured and cured, the perimeter skirts may be structurally secured to the slab foundation. In some embodiments, anchors were installed on the perimeter skirts prior to pouring the substrates, and the poured substrates may envelop the anchors such that the perimeter skirts become structurally secured to the slab foundation via the anchors once the curing process is completed. In additional or alternative embodiments, anchors may be installed on the perimeter skirts after the curing process is complete, embedding the anchors in a formed slab foundation and thereby securing the perimeter skirts to the slab foundation.

Replacing conventional perimeter beams (e.g., extensions of slab foundation 170 into perimeter trench 140 as discussed with respect to FIG. 1) with perimeter skirts to preserve the integrity of the void space results in using less quantities of substrate materials. This may also result in shorter overall curing times, as the curing times for the slab foundation are no longer dependent on the curing times for the perimeter beams, which could vary depending on soil moisture levels (e.g., proportional to the soil depths to which the perimeter beams extended). Improper curing times for perimeter beams may introduce creep and shrinkage, which can compromise the structural integrity of perimeter beams and undermine the perimeter beams' capacity to resist soil migration and/or ingress over time. Additionally, the removal of conventional perimeter beams may result in using lesser quantities of foundation reinforcements, such as rebar and ties. Also, the perimeter skirt materials (e.g., vinyl sheet, sheet metal, wood panel, etc.) are often cheaper than the materials used in perimeter beams (e.g., concrete, rebar and ties, etc.) and easier to install. These factors, separately and in the aggregate, contribute to reduced material and labor costs when using perimeter skirts over perimeter beams.

After the slab foundation has been formed, at block 550, process 500 may further include lifting the slab foundation. Preferably, each section of the slab foundation is lifted at the same time so that the slab foundation is raised in a uniform fashion. For example, when using lifting assemblies, force should be applied to all of the lifting assemblies at the same time, thereby causing the entire slab foundation to be raised, as one unit, to the desired height. Additionally or alternatively, each portion of the slab foundation may be separately raised in an incremental manner such that the structural integrity of the slab foundation is not compromised.

By lifting the slab above the ground, a void space (e.g., void 280 of FIG. 2E) may be created. In accordance with embodiments, the void space may provide a buffer against vertical soil expansion, thereby allowing the ground soil to expand within the void space without causing upward forces on the bottom of the slab foundation. The benefits afforded by the void space may be compromised if there is too much lateral soil migration and/or ingress into the void space from the ground exterior to the perimeter of the slab foundation, thereby filling in and, overtime, eliminating the void space. The perimeter skirts of embodiments function to circumscribe the void space along the slab foundation's perimeter and preserve the void space by preventing lateral soil migration and/or ingress into the void space.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for resisting lateral soil migration into a void beneath a foundation lifted above a ground surface, the method comprising:

placing a plurality of skirts in the ground surface, wherein the plurality of skirts defines a perimeter of the foundation, wherein each skirt comprises a first portion and a second portion, wherein a first side of each of the plurality of skirts defines an interior of the perimeter of the foundation and a second side each of the plurality of skirts defines an exterior of the perimeter of the foundation, wherein one or more anchors protrude from the first side of the first portion of each of the plurality of skirt, and wherein the second portion is set in the ground surface; and forming a slab within the interior of the perimeter, wherein the one or more anchors of each of the plurality of skirts are embedded within the slab, wherein the slab is configured to be raised above the ground surface, wherein raising the slab above the ground surface creates a void between the slab and the ground surface and lifts the plurality of skirts along with the slab, and wherein the plurality of skirts circumscribe the void and is configured as a barrier between the void and soil at the exterior of the perimeter of the foundation.

2. The method of claim 1, further comprising:

placing the one or more anchors through the first portion of each of the plurality of skirts.

3. The method of claim 1, wherein the one or more anchors comprise pins configured to be snapped through each of the plurality of skirts, wherein the pins enter each of the plurality of skirts from the second side and exit through the first side.

4. The method of claim 1, wherein at least one of the plurality of skirts is configured to fold along one or more pivot points, wherein raising the slab above the ground surface causes the at least one of the plurality of skirts to unfold along the one or more pivot points.

5. The method of claim 1, wherein each of the plurality of skirts comprises material configured to resist lateral expansion of soil from the exterior of the perimeter of the foundation into the void.

6. The method of claim 1, wherein a vertical length of the second portion of each of the plurality of skirts exceeds a vertical dimension of the void, wherein the vertical dimension of the void comprises a distance between the slab and the ground surface.

7. The method of claim 6, wherein a sub-portion of the second portion of each of the plurality of skirts remains below the ground surface after the slab is raised above the ground surface, wherein the sub-portion below the ground surface is sufficiently secured by the ground surface against lateral movement.

8. The method of claim 1, wherein each of the skirts are further configured to operate as form boards for said forming the slab within the interior of the perimeter of the foundation.

9. The method of claim 1, wherein the anchors of one or more skirts of the plurality of skirts are removable, wherein the removable anchors facilitate removal of the one or more skirts.

10. A system for resisting lateral soil migration beneath a foundation lifted above a ground surface, the system comprising:

a plurality of skirts that defines a perimeter of the foundation, wherein each of the plurality of skirts comprises a first portion, a second portion, and a third portion, wherein a first side of the first portion of each skirt defines an interior of the perimeter of the foundation and a second side of the first portion of each skirt defines an exterior of the perimeter of the foundation, wherein the first portion of each skirt is structurally secured to a slab lifted above the ground surface, wherein the lifted slab is formed within the interior of the perimeter of the foundation, wherein the second portion of each skirt circumscribes a void between the lifted slab and the ground surface, wherein the second portion is configured as a barrier between the void and soil at the exterior of the perimeter of the foundation, and wherein the third portion of each skirt is set in the ground surface, wherein the third portion is configured to permit vertical movement and resist lateral movement; and one or more anchors protruding from the first side of the first portion of each skirt, wherein the one or more anchors of each skirt are embedded within the lifted slab, wherein the first portion of each skirt is structurally secured to the lifted slab via the one or more anchors.

11. The system of claim 10, wherein the one or more anchors are placed through the first portion of each of the plurality of skirts.

12. The system of claim 11, wherein each of the plurality of skirts are further configured to operate as form boards for said forming the lifted slab within the interior of the perimeter of the foundation.

13. The system of claim 11, wherein the anchors of one or more skirts of the plurality of skirts are removable, wherein the removable anchors facilitate removal of the one or more skirts.

14. The system of claim 10, wherein the one or more anchors comprise pins configured to be snapped through each of the plurality of skirts, wherein the pins enter each of the plurality of skirts from the second side and exit through the first side.

15. The system of claim 10, wherein at least one of the plurality of skirts is configured to fold along one or more pivot points, wherein lifting the slab above the ground surface causes the at least one of the plurality of skirts to unfold along the one or more pivot points.

16. The system of claim 10, wherein each of the plurality of skirts comprises material configured to resist lateral expansion of soil from the exterior of the perimeter of the foundation into the void.

17. The system of claim 10, wherein a vertical length of the second portion of each of the plurality of skirts exceeds a vertical dimension of the void, wherein the vertical dimension of the void comprises a distance between the lifted slab and the ground surface.

18. The system of claim 17, wherein a sub-portion of the second portion of each of the plurality of skirts remains below the ground surface, wherein the sub-portion below the ground surface is sufficiently secured by the ground surface against lateral movement.

19. A system for resisting lateral soil migration beneath a foundation lifted above a ground surface, the system comprising:

a skirt, wherein vertical dimensions of the skirt corresponds to a vertical height to which a slab will be lifted, wherein the skirt comprises a first portion, a second portion and a third portion, wherein the first portion of the skirt is configured to be structurally secured to the slab, wherein the second portion of the skirt is configured to correspond to a vertical height to which the slab will be vertically lifted from the ground surface after forming the slab on the ground surface, and wherein the second portion is configured to be beneath the ground surface during forming of the slab and at least a portion thereof to be raised above the ground surface after the slab is vertically lifted from the ground surface, and wherein the third portion of the skirt is configured to be set in the ground surface both during forming the slab and after the slab is vertically lifted from the ground surface, wherein the third portion is configured to permit vertical movement and resist lateral movement; and one or more anchors associated with the skirt, wherein the one or more anchors are configured to structurally secure the skirt to the slab.

20. The system of claim 19, wherein the one or more anchors are further configured to be installed on the skirt by placing the one or more anchors through a first side of the skirt to protrude from a second side of the skirt.

21. The system of claim 19, wherein the first portion of the skirt is configured as the one or more anchors.

22. The system of claim 19, wherein the skirt is configured to fold and unfold along one or more pivots points.

* * * * *